US006889580B1

(12) United States Patent
Tseng

(10) Patent No.: US 6,889,580 B1
(45) Date of Patent: May 10, 2005

(54) SOCKET FOR ADAPTING ITSELF TO OPEN ENDS OF WRENCHES OF DIFFERENT SIZES

(75) Inventor: Kai-Chung Tseng, Taichung (TW)

(73) Assignee: A.A.G. Industrial Co., Ltd., Taichung (TW)

( * ) Notice: Subject to any disclaimer, the term of this patent is extended or adjusted under 35 U.S.C. 154(b) by 0 days.

(21) Appl. No.: 10/828,709

(22) Filed: Apr. 19, 2004

(51) Int. Cl.[7] ..... B25B 13/00
(52) U.S. Cl. ..... 81/124.6; 411/410; 411/402; 411/910; 411/408
(58) Field of Search ..... 81/124.6, 121.1, 81/124.3, 124.7; 411/402, 408, 410, 910; 292/68

(56) References Cited

U.S. PATENT DOCUMENTS 3,868,873 A * 3/1975 Evans ..... 81/119
3,875,829 A * 4/1975 Evans et al. ..... 81/185
3,996,819 A * 12/1976 King ..... 81/124.6
4,444,301 A * 4/1984 Granberry ..... 193/35 R
4,602,534 A * 7/1986 Moetteli ..... 81/177.85
5,674,036 A * 10/1997 Hsieh ..... 411/410
6,062,786 A * 5/2000 Garver et al. ..... 411/386
6,321,625 B1 * 11/2001 Fernandez ..... 81/176.2
6,422,053 B1 * 7/2002 Greuel et al. ..... 72/397

FOREIGN PATENT DOCUMENTS

GB 2246534 A * 2/1992

* cited by examiner

*Primary Examiner*—Joseph J. Hail, III
*Assistant Examiner*—Bryan Muller
(74) *Attorney, Agent, or Firm*—W. Wayne Liauh

(57) ABSTRACT

A socket capable of adapting itself to an open end of one of a plurality of wrenches of different sizes is disclosed. The socket comprises a lower connecting section including a cavity, and a four-sided actuation block projected from a top of the connecting section, the actuation block including two curved bearing surfaces having different curvatures. The actuation block is operable to be held by an open end of the wrench with two opposite interior surfaces of the open end of the wrench being in contact with two points of the bearing surfaces so that turning the wrench will fasten or unfasten an object coupled to the cavity.

5 Claims, 17 Drawing Sheets

SOCKET FOR ADAPTING ITSELF TO OPEN ENDS OF WRENCHES OF DIFFERENT SIZES

BACKGROUND OF THE INVENTION

1. Field of the Invention

The present invention relates to sockets for wrenches and more particularly to an improved socket which is able to adapt itself to an open end of one of a plurality of wrenches of different sizes.

2. Description of Related Art

There are a variety of wrenches (e.g., open end wrenches, box end wrenches, combination box and open end wrenches, flare nut wrenches, etc.) commercially available. Further, a wide variety of sockets in cooperation with the wrenches are available. As shown in FIG. 1, a conventional socket 1 comprises a lower connecting section 2 in the shape of cavity having a section of hexagon, the connecting section 2 being adapted to couple to an object to be fastened or unfastened, and an upper coupling section 3 in the shape of cavity having a section of square, the connecting section 3 being adapted to couple to a protrusion 5 on the bottom of a wrench 4. However, the socket 1 may be useless if a wrench having a conformed protrusion is not immediately available. This can bring inconvenience in use.

For increasing convenience of socket in use, there have been numerous suggestions in prior patents. For example, Taiwanese Patent Application No. 87208151 entitled "Socket for Spark Plug" is shown in FIGS. 2 and 3. The socket 6 comprises a cylindrical connecting section 7 at one end having a cavity therein, and a projected actuation block 8 at the other end, the actuation block 8 having a section of hexagon. Further, a recessed coupling section 9 having a section of square is formed on top of the actuation block 8. An open end wrench 10 can hold the actuation block 8 in its open end for working. However, only an open end wrench having a conformed size is adapted to hold the actuation block 8 in its open end. In other words, open end wrenches other than the above size are useless (i.e., incompatible). Thus, use convenience is still not improved.

Another Taiwanese Patent Application No. 87220532 entitled "Socket Having a Hexagonal Actuation Block" is shown in FIGS. 4 and 5. The socket 11 comprises a cylindrical connecting section 12 at one end having a cavity therein, and a projected actuation block 13 at the other end, the actuation block 13 having an arcuate, tapered lower end and a section of hexagon (i.e., there are six curved upper bearing sides 15 and six curved lower bearing sides 14). An aperture 16 is formed in each bearing side 15. Further, a recessed coupling section 17 having a section of square is formed on top of the actuation block 13. A wrench 18 can hold the actuation block 13 in its ratchet box end in which the socket 11 is adapted to adjust its angle by disposing the lower bearing sides 14 and the apertures 16 in different orientations. However, only a ratchet wrench having a conformed size is adapted to hold the actuation block 13 in its box end. In other words, ratchet wrenches other than the above size are useless (i.e., incompatible). Thus, use convenience is still not improved.

Thus, it is desirable to provide a novel socket for adapting itself to an open end of one of a plurality of wrenches of different sizes in order to overcome the above drawbacks of the prior art.

SUMMARY OF THE INVENTION

It is an object of the present invention to provide a socket which is able to adapt itself to an open end of one of aplurality of wrenches of different sizes if a wrench having a protrusion at one end is not immediately available for use.

In one aspect of the present invention, there is provided a socket worked in cooperation with one of a plurality of wrenches of different sizes, comprising a lower connecting section including a cavity; and a four-sided actuation block projected from a top of the connecting section, the actuation block including two curved bearing surfaces having different curvatures; wherein the actuation block is operable to be held by an open end of the wrench with two opposite interior surfaces of the open end of the wrench being in contact with two points of the bearing surfaces so that turning the wrench will fasten or unfasten an object coupled to the cavity.

In another aspect of the present invention, there is provided a socket worked in cooperation with one of a plurality of wrenches of different sizes, comprising a lower connecting section including a cavity; and a four-sided actuation block projected from a top of the connecting section, the actuation block including two bearing surfaces being not parallel with respect to each other; wherein the actuation block is operable to be held by an open end of the wrench with two opposite interior surfaces of the open end of the wrench being in contact with two points of the bearing surfaces so that turning the wrench will fasten or unfasten an object coupled to the cavity.

In still another aspect of the present invention, there is provided a socket worked in cooperation with one of a plurality of wrenches of different sizes, comprising a lower connecting section including a bottom cavity and a top cavity having a section of a predetermined shape; and a separate actuation block including a lower protrusion having a section of the predetermined shape, the protrusion being adapted to insert into the cavity for coupling, and an upper four-sided member including two bearing surfaces of either being curved and having different curvatures or being not parallel with respect to each other; wherein the actuation block is operable to be held by an open end of the wrench with two opposite interior surfaces of the open end of the wrench being in contact with two points of the bearing surfaces so that turning the wrench will fasten or unfasten an object coupled to the cavity.

In yet another aspect of the present invention the bearing surface comprises a slip resistant member formed thereon.

The above and other objects, features and advantages of the present invention will become apparent from the following detailed description taken with the accompanying drawings.

DETAILED DESCRIPTION OF THE PREFERRED EMBODIMENTS

Figure 1:
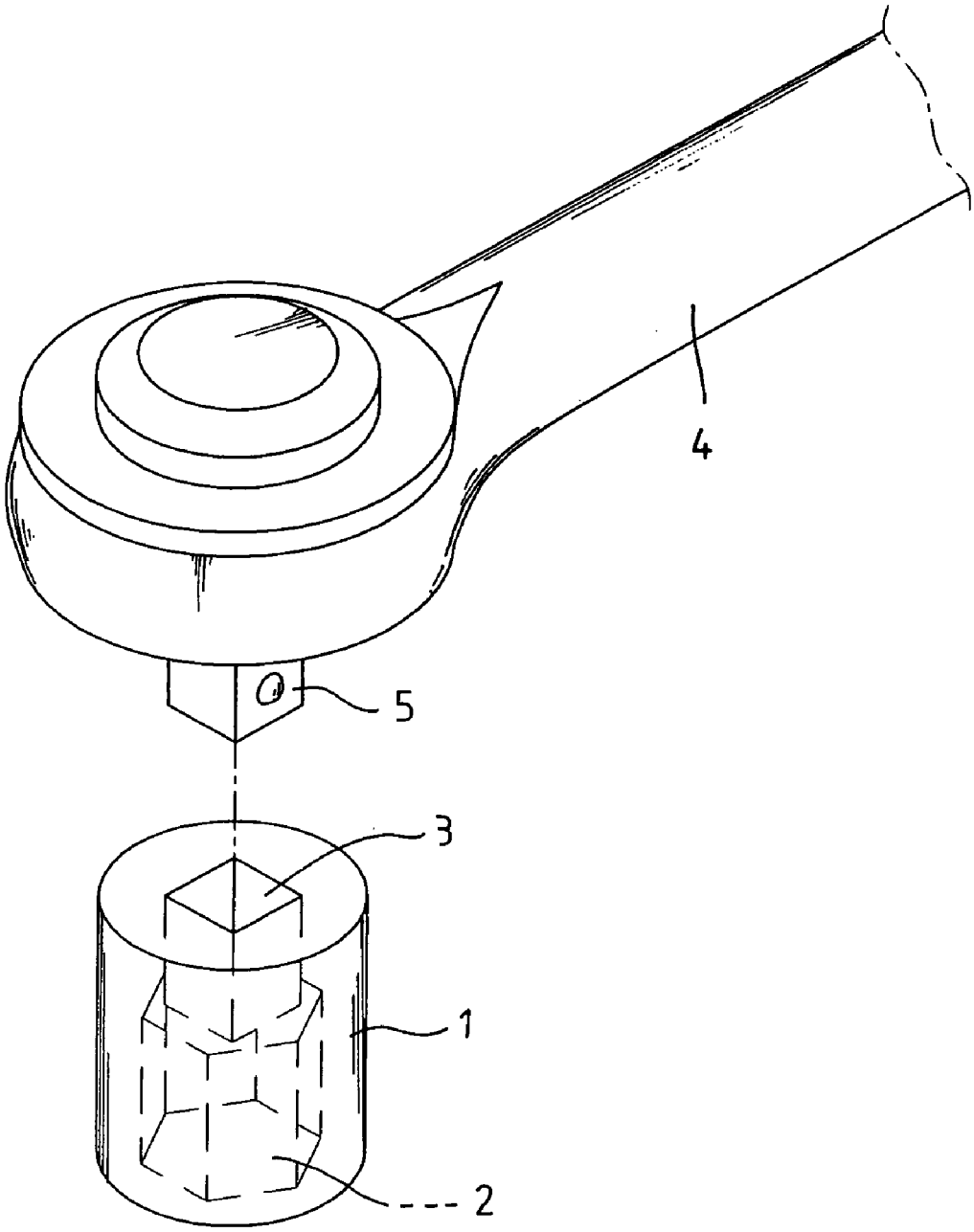
F I G . 1 PRIOR ART
FIG. 1 is a perspective view of a first conventional socket adapted to couple to a wrench.
Figure 2:
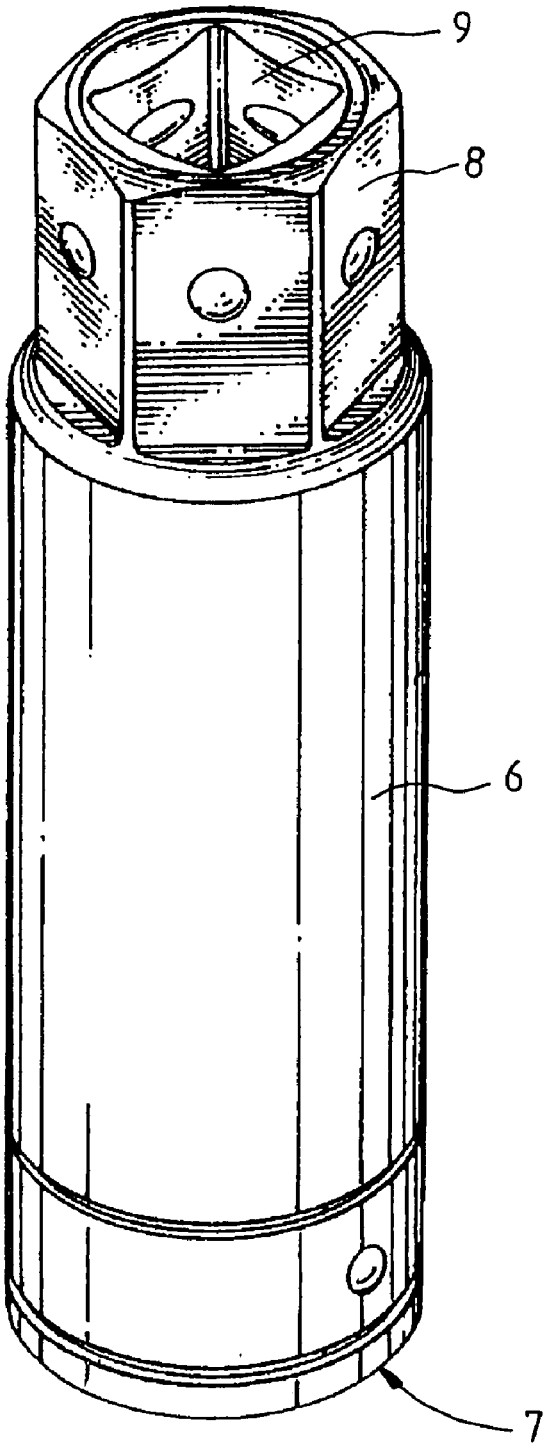
F I G . 2 PRIOR ART
FIG. 2 is a perspective view of a second conventional socket.
Figure 3:
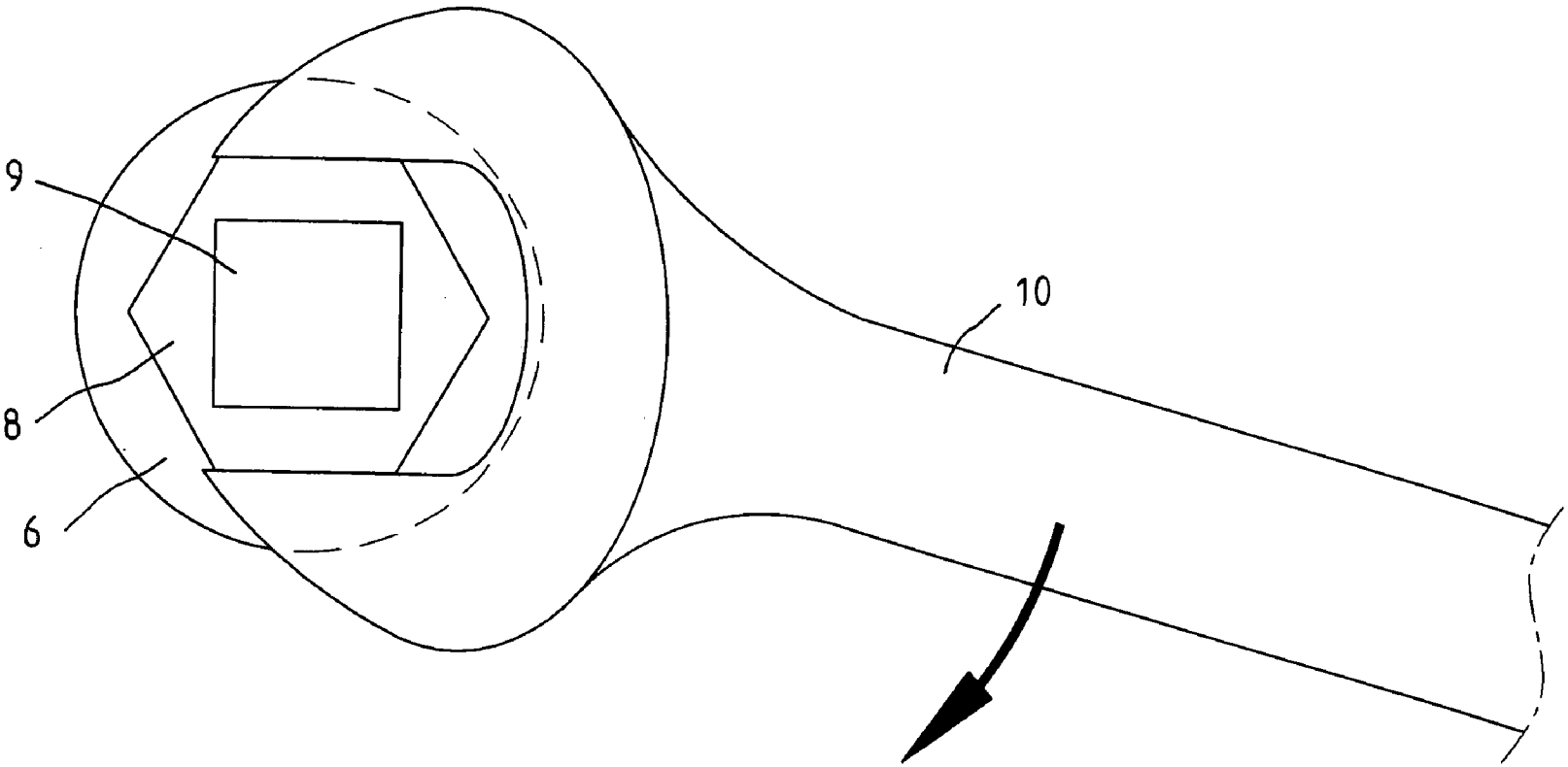
FIG. 3 PRIOR ART
FIG. 3 is a perspective view of the second conventional socket held by the open end of a wrench.
Figure 4:
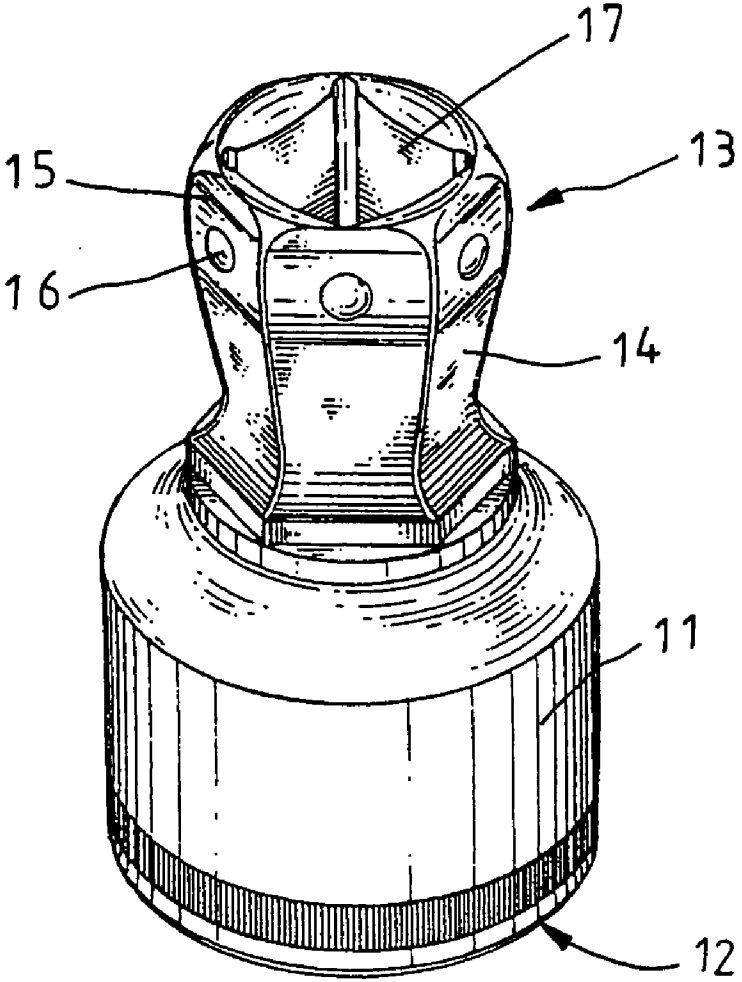
FIG. 4 PRIOR ART
FIG. 4 is a perspective view of a third conventional socket.
Figure 5:
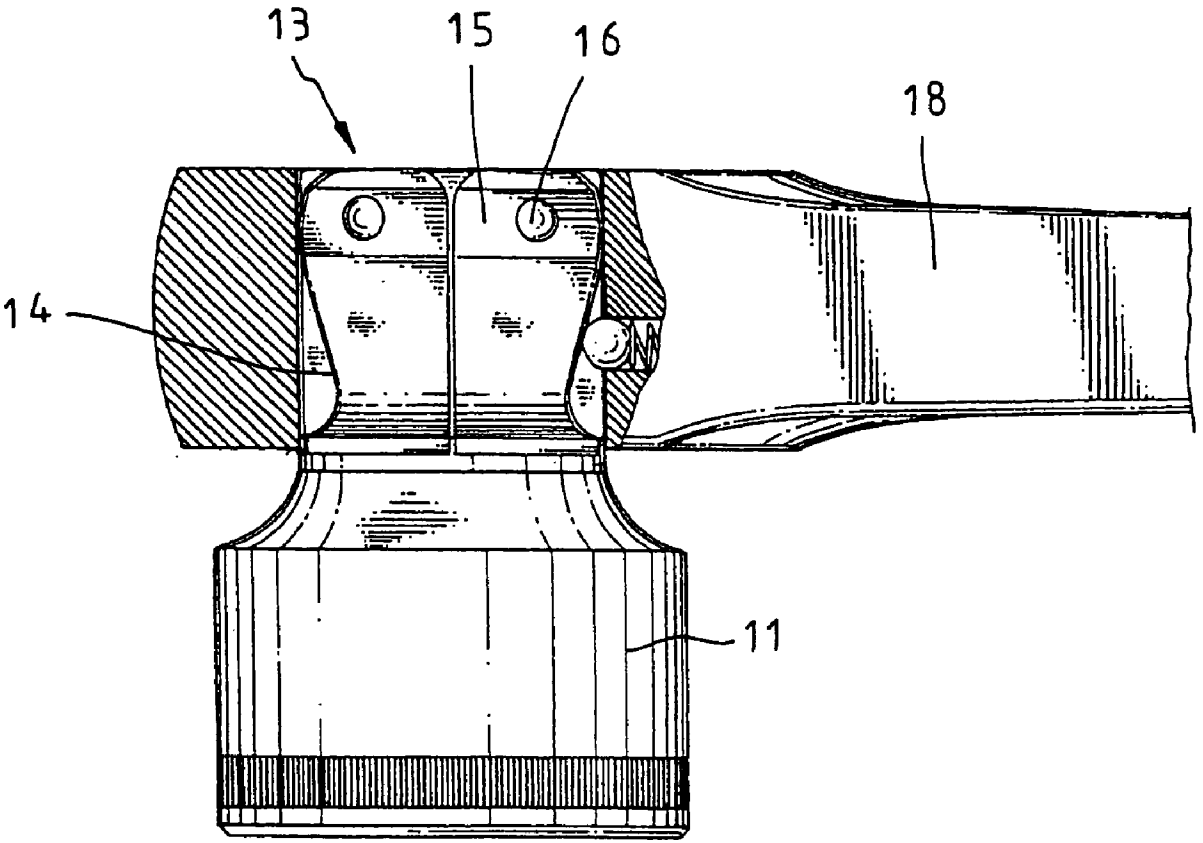
FIG. 5 PRIOR ART
FIG. 5 is a broken-away side view of the third conventional socket held by the box end of a ratchet wrench.
Figure 6:
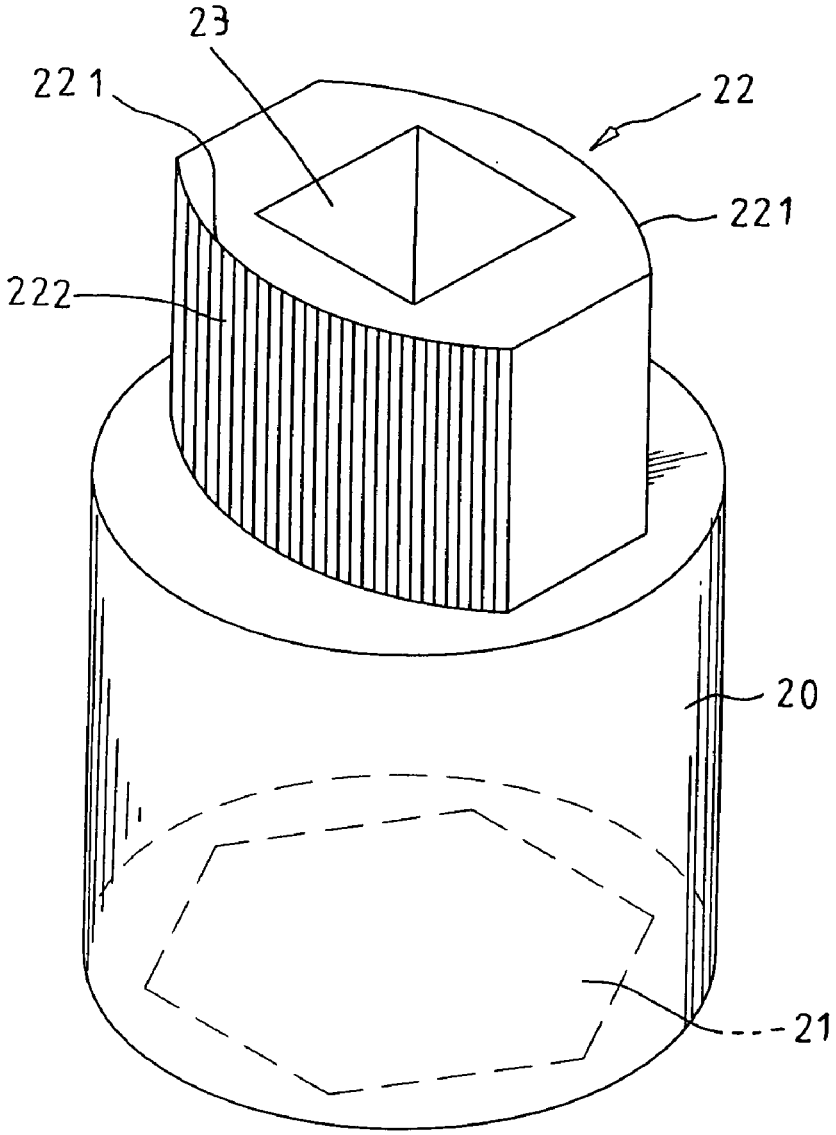
FIG. 6 is a perspective view of a first preferred embodiment of socket according to the invention.
Figure 7:
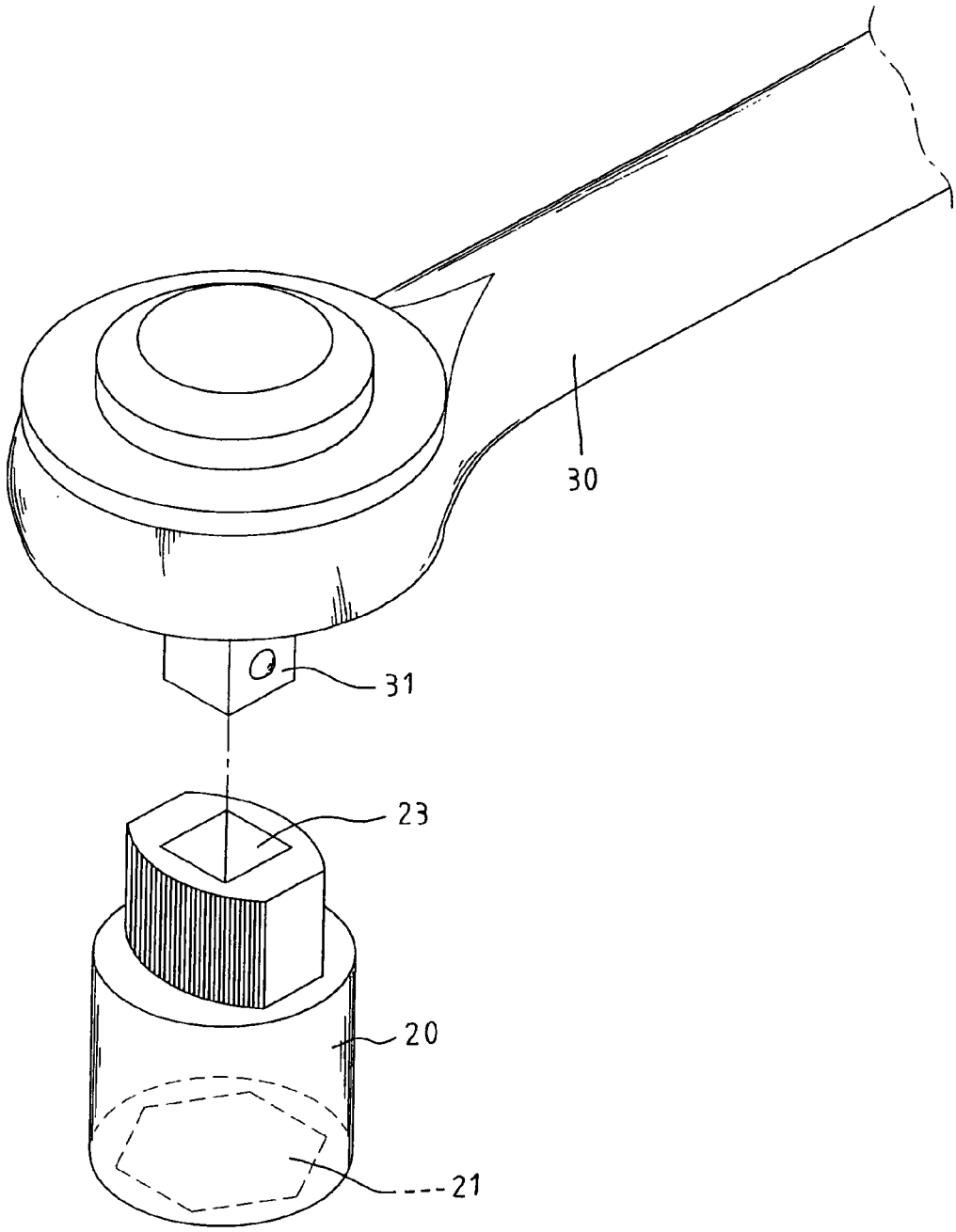
FIG. 7 is a perspective view of the socket in FIG. 6 to be coupled to a wrench.

Referring to FIGS. 6 and 7, a socket 20 constructed in accordance with a first preferred embodiment of the invention is shown. The socket 20 comprises a lower, cylindrical connecting section 21 having a cavity therein, the cavity having a section of hexagon, and an actuation block 22 projected from a top of the connecting section 21. The actuation block 22 is a four-sided member in which two curved bearing surfaces 221 have different curvatures. Each bearing surface 221 has a slip resistant member 222 formed thereon. A recessed coupling section 23 having a section of square is formed on top of the actuation block 22. As shown in FIG. 7, a protrusion 31 of a wrench 30 is to be inserted into the coupling section 23 for coupling. Further, an object (not shown) to be worked is inserted into the connecting section 21 for coupling. As such, a turning of the wrench 30 will fasten or unfasten the object via the socket 20.

Figure 8:
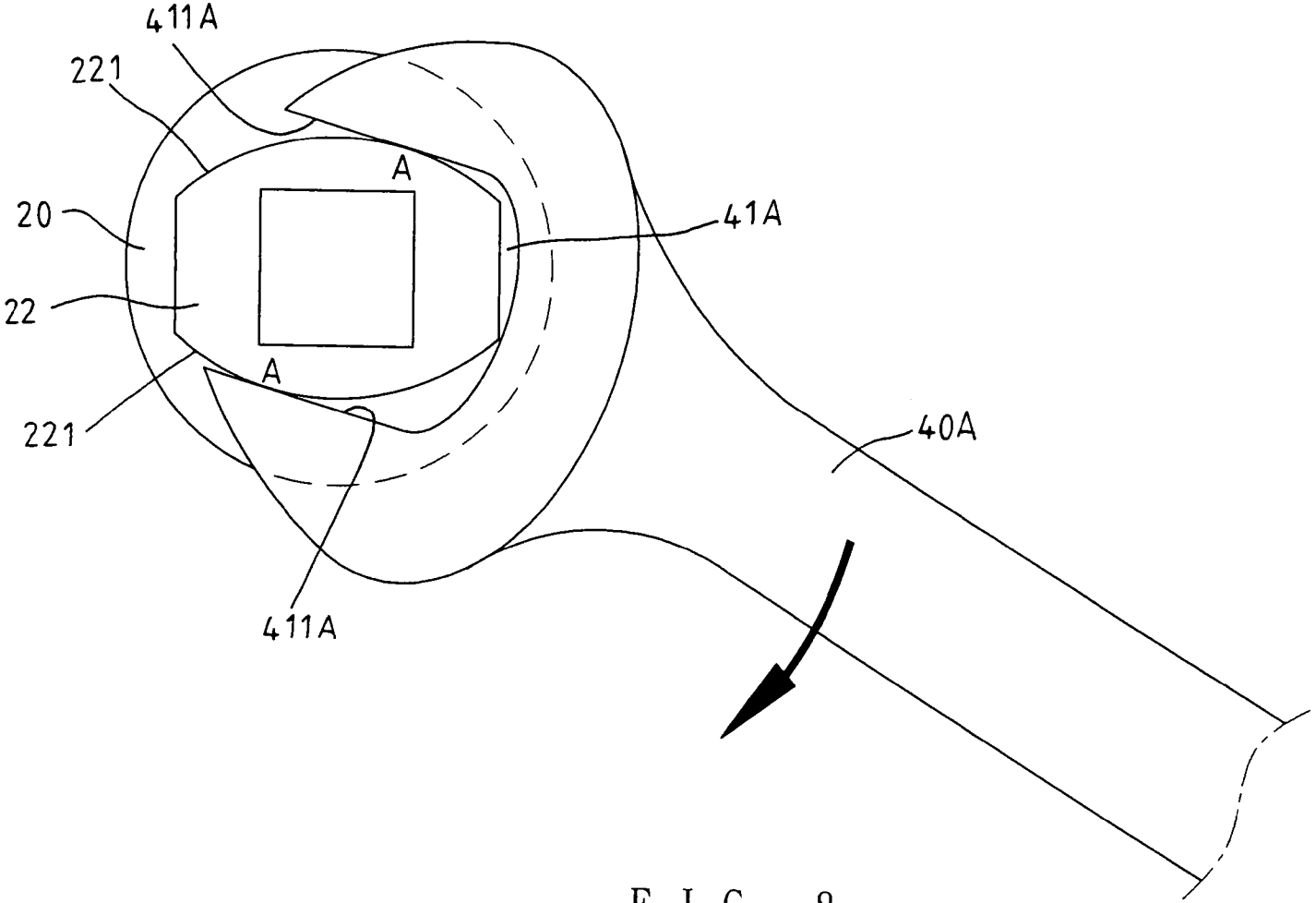
FIG. 8 is a top plan view of the actuation block of the socket in FIG. 6 held by the open end of a wrench of size A.
Figure 9:
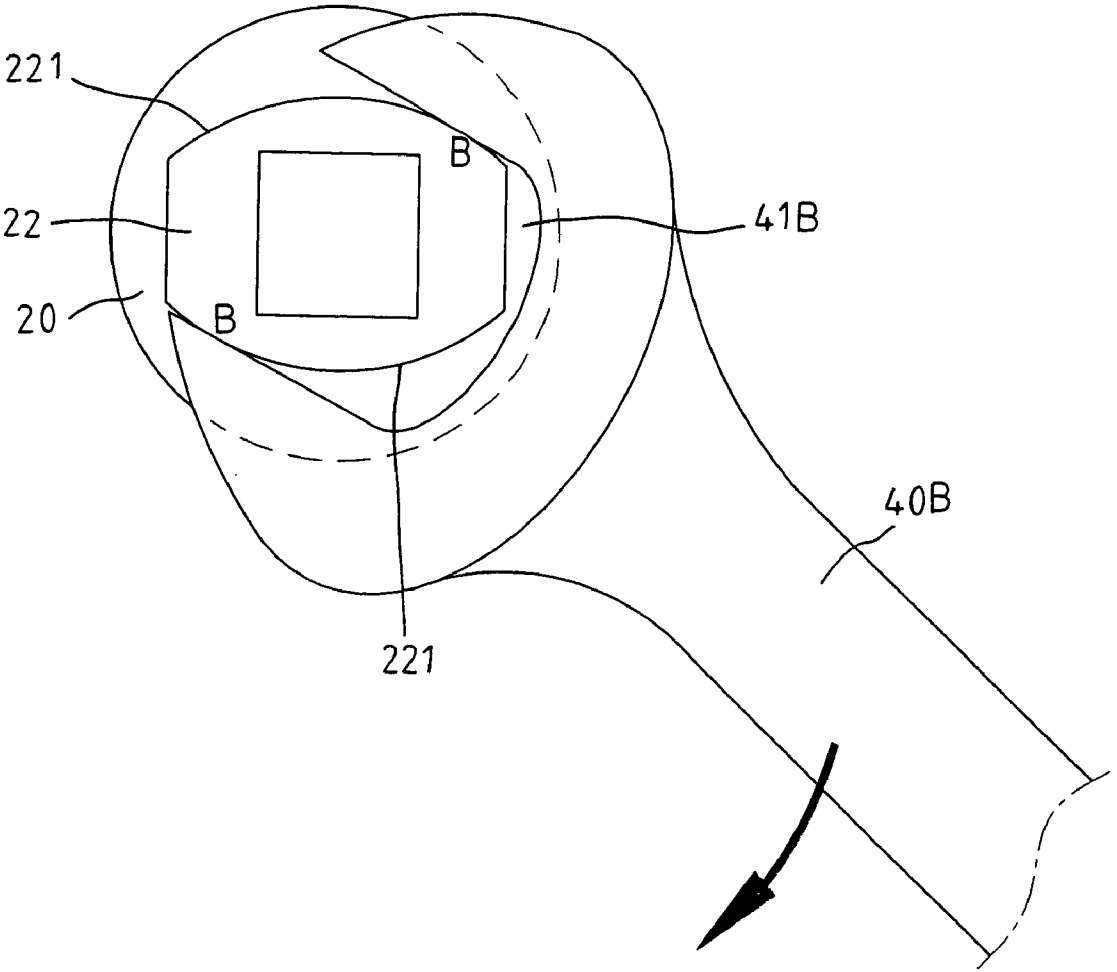
FIG. 9 is a top plan view of the actuation block of the socket in FIG. 6 held by the open end of a wrench of size B.
Figure 10:
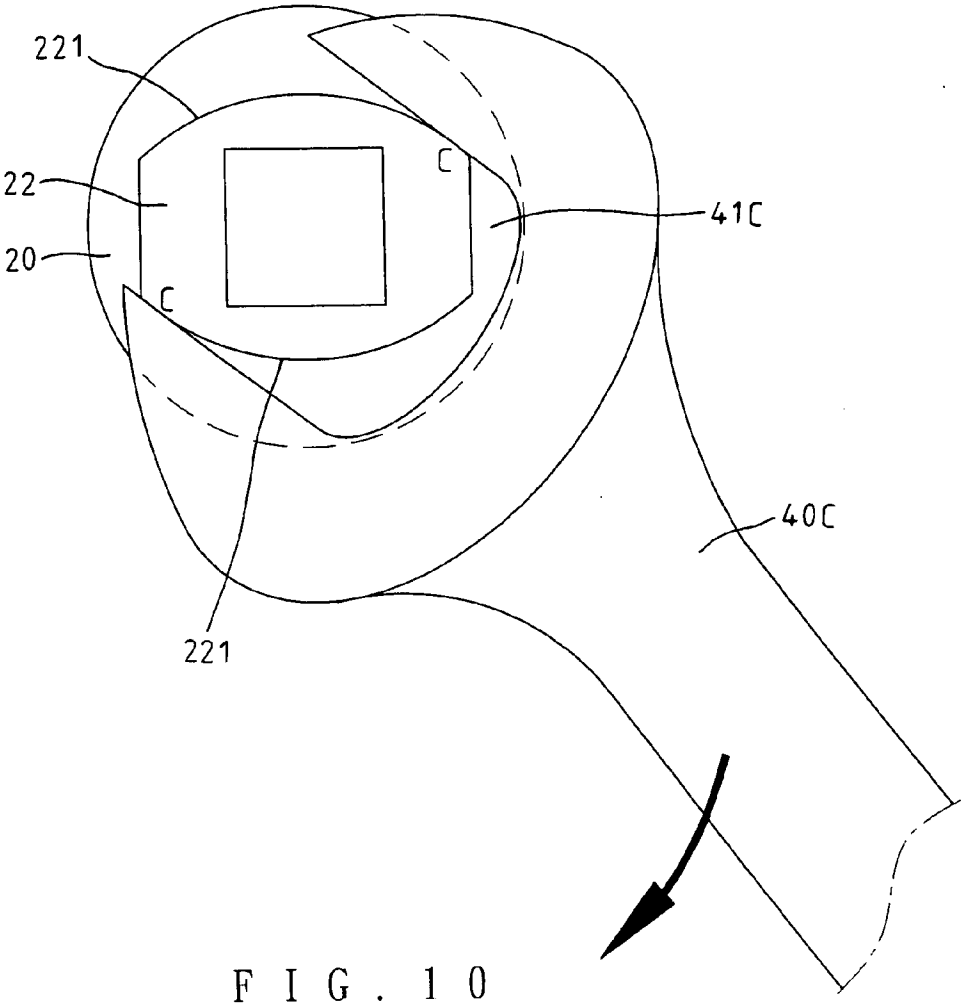
FIG. 10 is a top plan view of the actuation block of the socket in FIG. 6 held by the open end of a wrench of size C.
Figure 11:
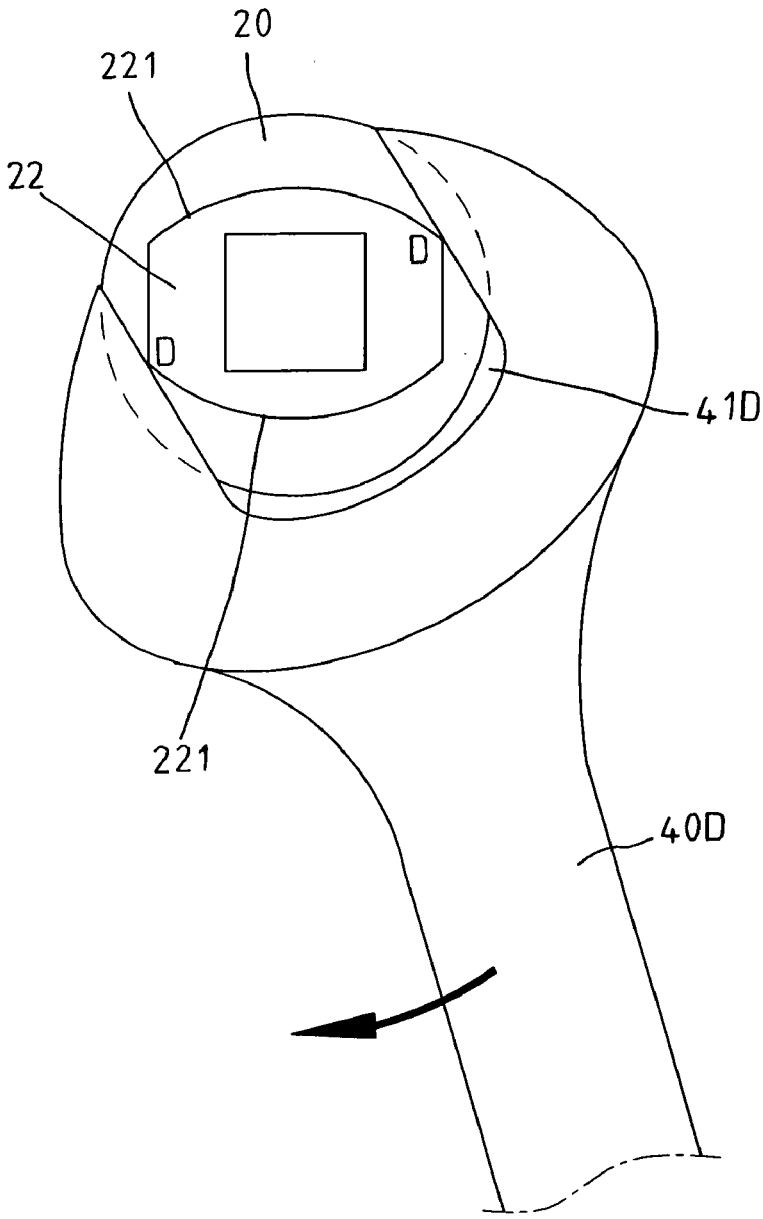
FIG. 11 is a top plan view of the actuation block of the socket in FIG. 6 held by the open end of a wrench of size D.

Referring to FIGS. 8 to 11, a user may use the following methods to turn the socket 20 if a wrench having a protrusion at one end is not immediately available. In FIG. 8, the actuation block 22 of the socket 20 is held by the open end 41A of a wrench 40A in which two opposite interior surfaces 411A of the open end 41A are in contact with points A of the bearing surfaces 221. The bearing surfaces 221 are held stably due to the provision of the slip resistant members 222 thereon. As such, a turning of the wrench 40A will fasten or unfasten the object via the socket 20. The holding of bearing surfaces 221 of the socket 20 at points B, C, or D in the open end 41B, 41C, or 41D by each of a number of different wrenches 40B, 40C, and 40D is illustrated in FIG. 9, 10, or 11 respectively. In brief, the socket 20 of the invention is highly adaptable.

Figure 12:
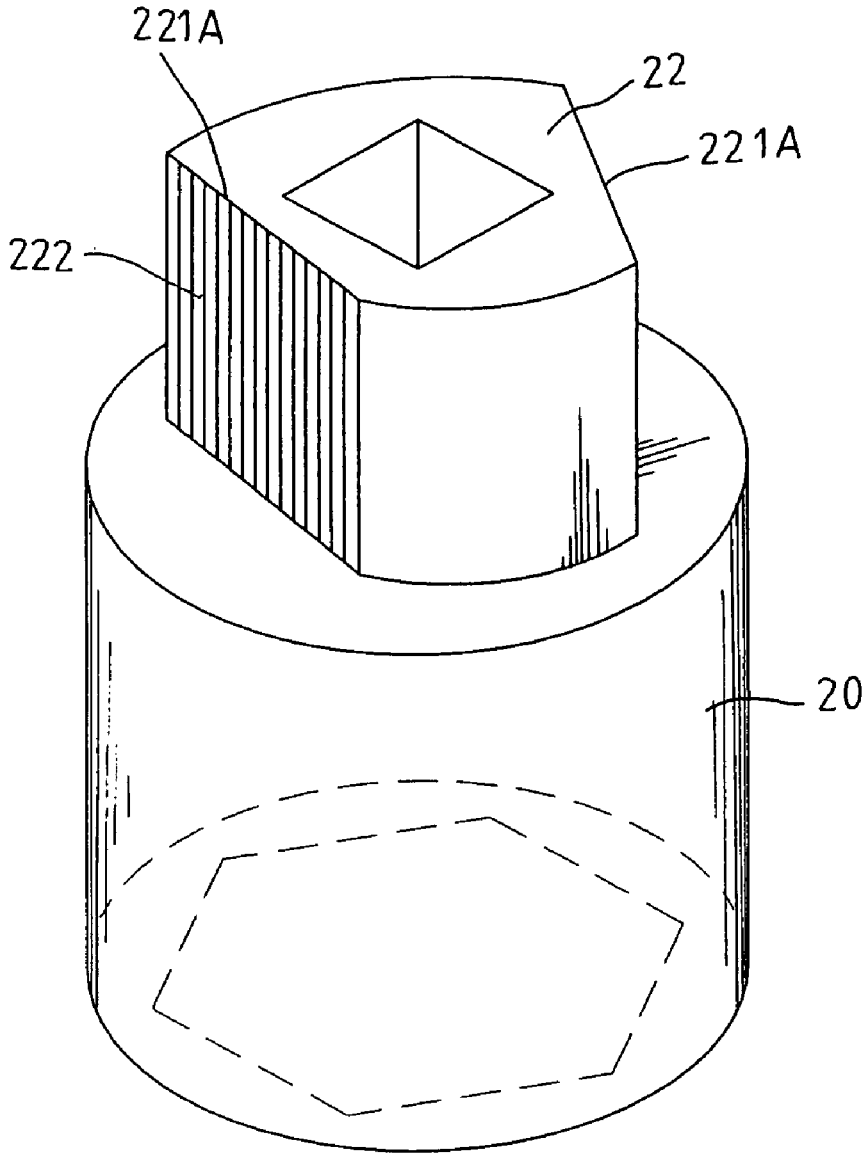
FIG. 12 is a perspective view of a second preferred embodiment of socket according to the invention.
Figure 13:
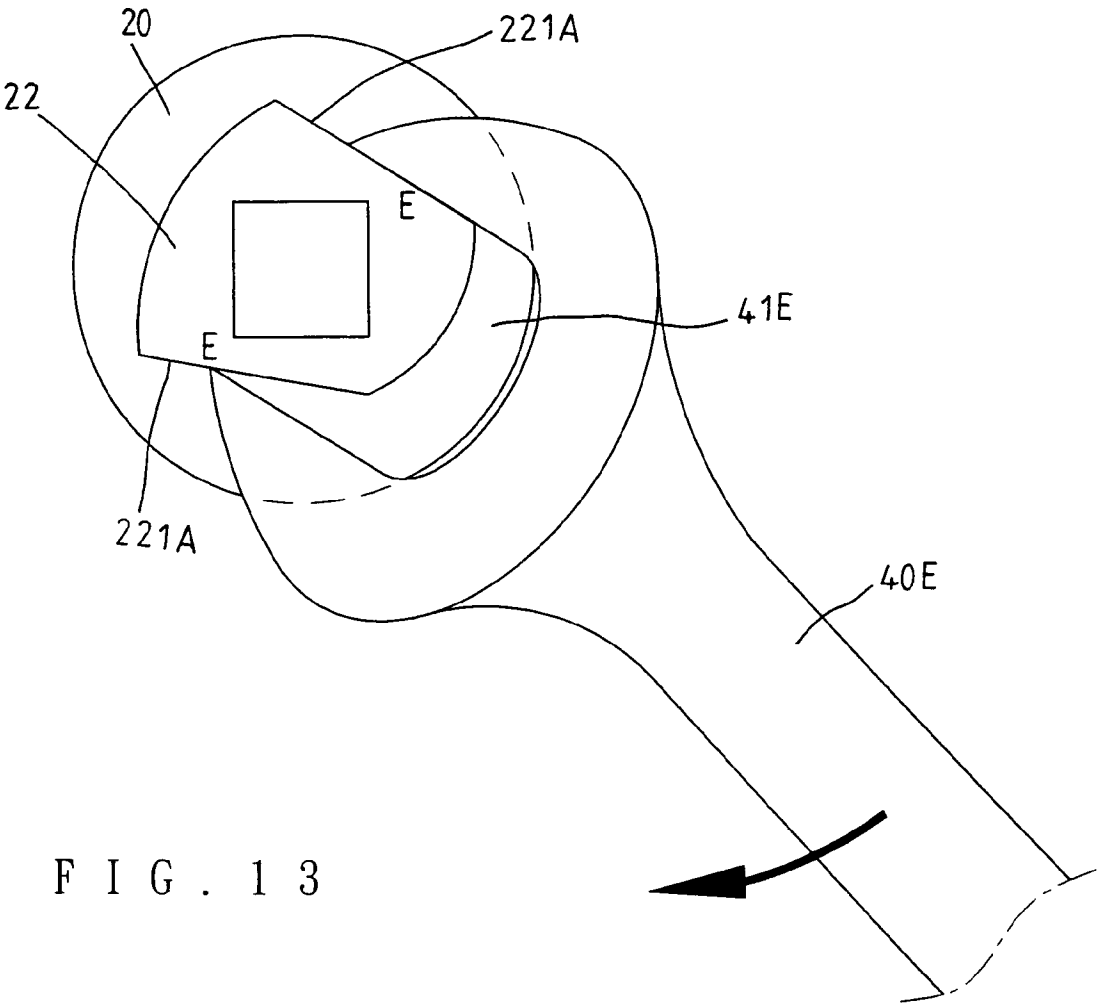
FIG. 13 is a top plan view of the actuation block of the socket in FIG. 12 held by the open end of a wrench of size E.
Figure 14:
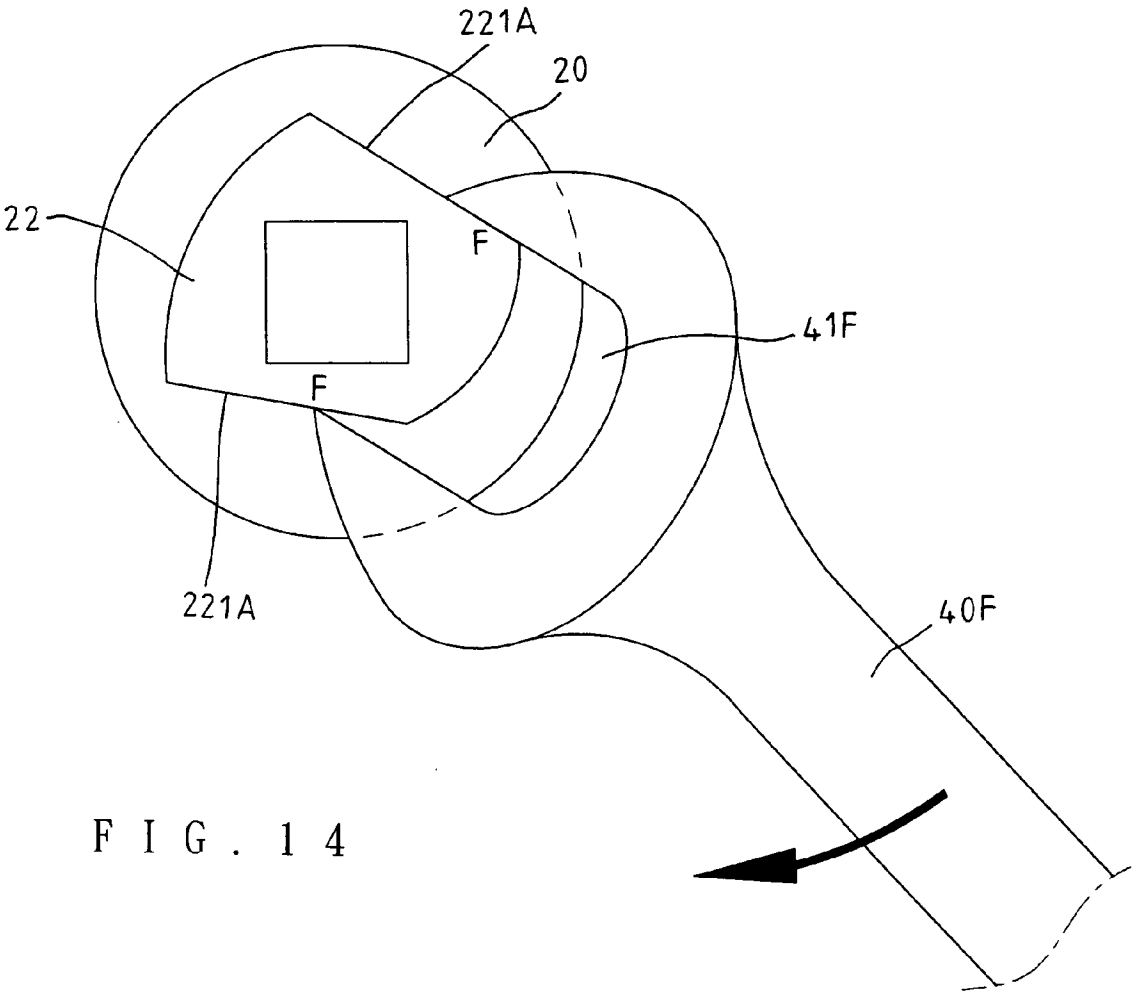
FIG. 14 is a top plan view of the actuation block of the socket in FIG. 12 held by the open end of a wrench of size F.

Referring to FIGS. 12 to 14, a socket 20 constructed in accordance with a second preferred embodiment of the invention is shown. The differences between the first and the second preferred embodiments, i.e., the characteristics of the second preferred embodiment are detailed below. The bearing surfaces 221A are substantially flat and are not parallel each other. A user may use the following methods to turn the socket 20 if a wrench having a protrusion at one end is not immediately available. In FIG. 13, the actuation block 22 of the socket 20 is held by the open end 41E of a wrench 40E in which two opposite interior surfaces of the open end 41E are in contact with points E of the bearing surfaces 221A. Also, a turning of the wrench 40E will fasten or unfasten the object via the socket 20. The holding of bearing surfaces 221 of the socket 20 at points F in the open end 41F by another different wrench 40F is illustrated in FIG. 14.

Figure 15:
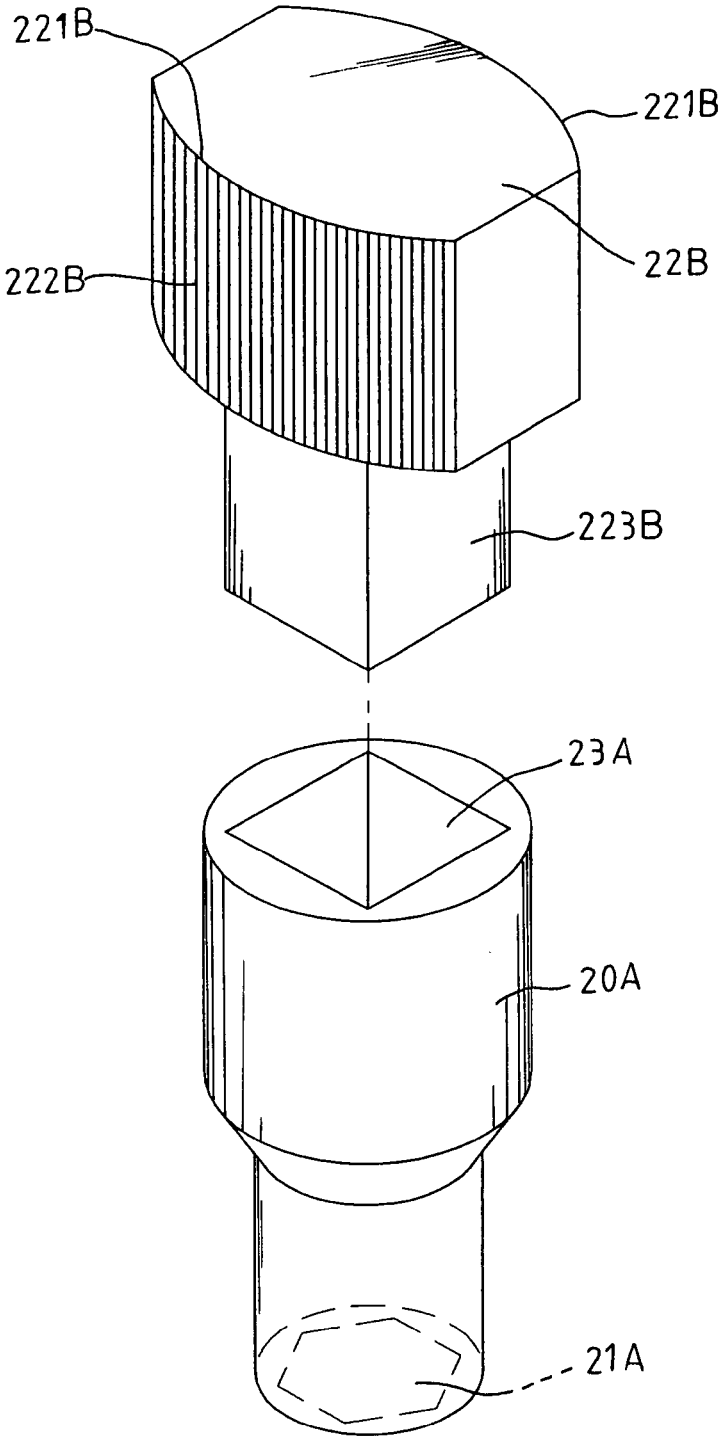
FIG. 15 is a perspective view of another configuration of the actuation block of the socket shown in FIG. 6.
Figure 16:
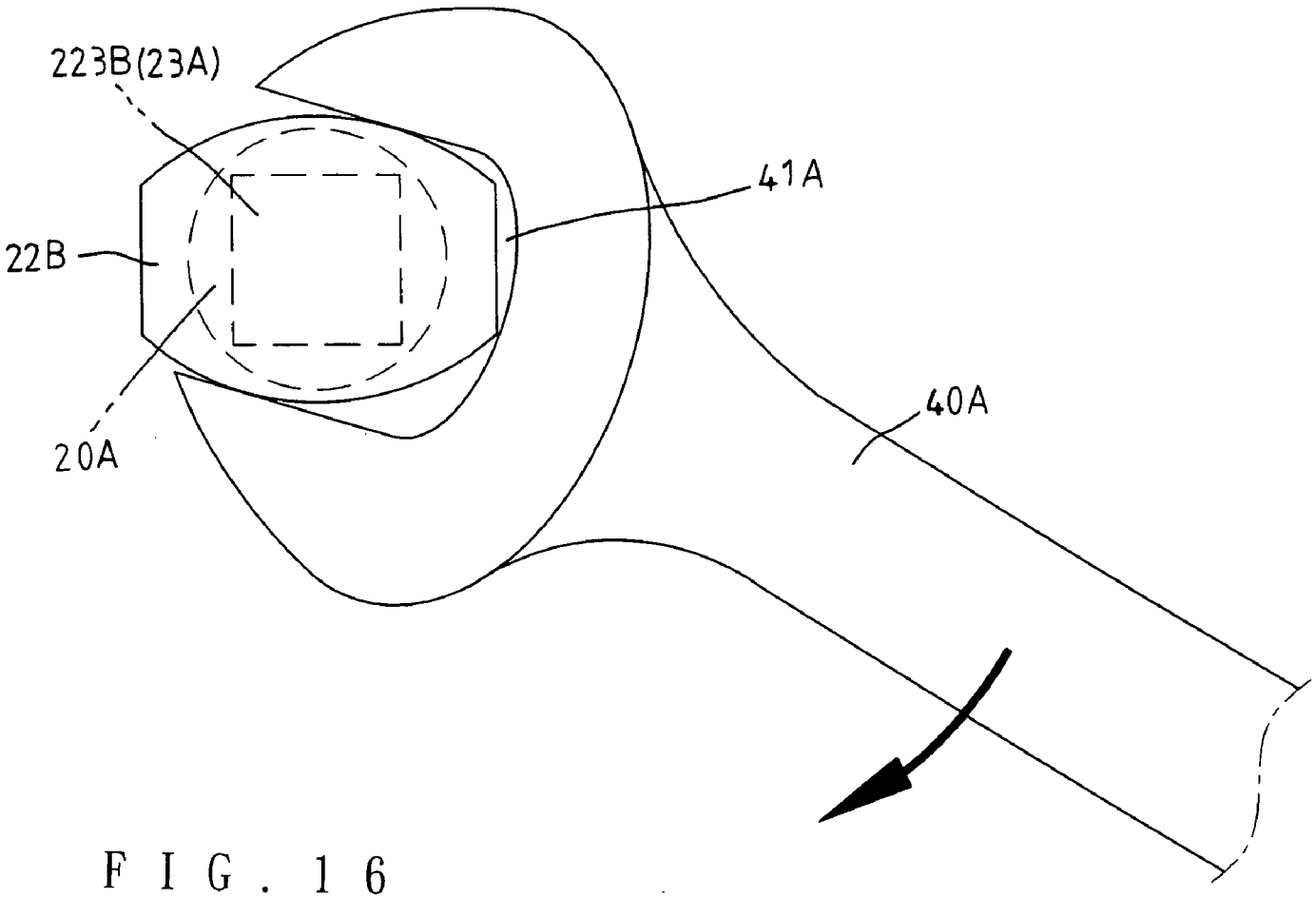
FIG. 16 is a top plan view of the actuation block of the socket in FIG. 15 held by the open end of a wrench.
Figure 17:
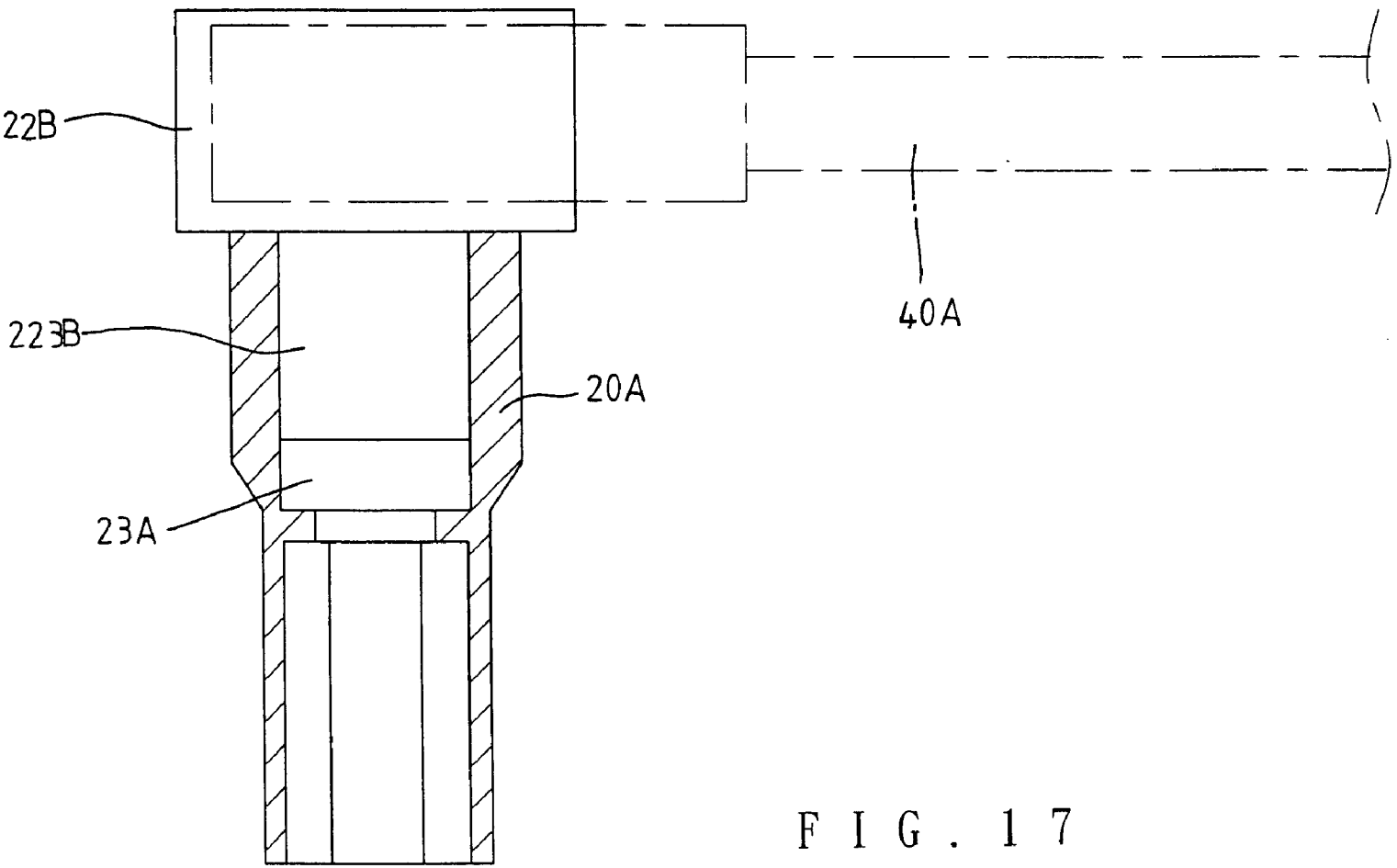
FIG. 17 is a side plan view in part section of the socket and the wrench shown in FIG. 16.

Referring to FIGS. 15 to 17, in another configuration the socket 20A comprises a lower, cylindrical connecting section 21A having a bottom cavity having a section of hexagon, and a top cavity 23A having a section of square; and a separate actuation block 22B including a lower protrusion 223B adapted to insert into the cavity 23A for coupling, and an upper four-sided member in which two curved bearing surfaces 221B have different curvatures. Each bearing surface 221B has a slip resistant member 222B formed thereon. Similarly, the actuation block 22B of the socket 20A is held by the open end 41A of the wrench 40A in which two opposite interior surfaces of the open end 41A are in contact with the bearing surfaces 221B. As such, a turning of the wrench 40A will fasten or unfasten the object via the socket 20A.

While the invention herein disclosed has been described by means of specific embodiments, numerous modifications and variations could be made thereto by those skilled in the art without departing from the scope and spirit of the invention set forth in the claims.

What is claimed is:

1. A socket worked in cooperation with one of a plurality of wrenches of different sizes, comprising:

a lower connecting section including a cavity; and a four-sided actuation block projected from a top of the connecting section, the actuation block including two bearing surfaces being not parallel with respect to each other;

wherein the actuation block is operable to be held by an open end of the wrench with two opposite interior surfaces of the open end of the wrench being in contact with two points of the bearing surfaces so that turning the wrench will fasten or unfasten an object coupled to the cavity.

2. The socket of claim 1, wherein the bearing surface comprises a slip resistant member formed thereon.

3. The socket of claim 1, wherein the actuation block comprises a recessed coupling section having a section of square formed on a top thereof.

4. A socket worked in cooperation with one of a plurality of wrenches of different sizes, comprising:

a lower connecting section including a bottom cavity and a top cavity having a section of a predetermined shape; and a separate actuation block including a lower protrusion having a section of the predetermined shape, the protrusion being adapted to insert into the cavity for coupling, and an upper four-sided member including two bearing surfaces;

wherein the actuation block is operable to be held by an open end of the wrench with two opposite interior surfaces of the open end of the wrench being in contact with two points of the bearing surfaces so that turning the wrench will fasten or unfasten an object coupled to the cavity;

further wherein the bearing surfaces are not parallel with respect to each other.

5. The socket of claim 4, wherein the bearing surfaces are curved and have different curvatures.

* * * * *